United States Patent [19]

Greco

[11] Patent Number: 4,570,467

[45] Date of Patent: Feb. 18, 1986

[54] LOCKING SYSTEM FOR ROLLING TYPE GATE

[76] Inventor: Vincent Greco, 195 Huntington Ave., Bronx, N.Y. 10465

[21] Appl. No.: 533,220

[22] Filed: Sep. 19, 1983

[51] Int. Cl.[4] ..... E05B 65/08

[52] U.S. Cl. ..... 70/99; 70/100; 70/140; 70/417; 70/418; 70/452; 292/346

[58] Field of Search ..... 70/95, 99, 100, 139, 70/140, 381, 417, 418, 452, DIG. 11, 77; 160/160, 161; 292/346

[56] References Cited

U.S. PATENT DOCUMENTS

| | | | |
|---|---|---|---|
| 1,479,657 | 1/1924 | Freysinger | 70/381 |
| 3,071,957 | 1/1963 | Golub | 70/95 X |
| 3,417,805 | 12/1968 | Kaufman et al. | 160/161 X |
| 3,446,046 | 5/1969 | Randel | 70/140 X |
| 3,506,056 | 4/1970 | Quinones et al. | 160/161 X |
| 3,600,912 | 8/1971 | Foreman | 70/95 X |
| 3,645,045 | 2/1972 | Gervis et al. | 70/452 X |
| 3,751,953 | 8/1973 | Newman | 70/452 X |
| 4,171,837 | 10/1979 | McRoy | 292/346 |
| 4,503,692 | 3/1985 | Grint | 70/417 X |

FOREIGN PATENT DOCUMENTS

| | | | |
|---|---|---|---|
| 1553621 | 1/1971 | Fed. Rep. of Germany | 70/139 |

*Primary Examiner*—Kenneth J. Dorner
*Assistant Examiner*—Lloyd A. Gall
*Attorney, Agent, or Firm*—Goodman & Tietelbaum

[57] ABSTRACT

A gate locking system for securely locking a rolling type gate in a closed position within an opposing pair of U-shaped channel guide rails. The guide rails include aligned apertures formed through opposing front and rear walls. The gate also includes an aperture which is aligned with the guide rail apertures when the gate is in the closed position. A guard plate is positioned exteriorly of the guide rails and also includes an aligned aperture. An elongated member of a lock is inserted through the various apertures to lock the members together in the closed position. The head of the lock is retained exteriorly of the guard plate while the distal end of the lock extends beyond the rear wall of the guide rail. A securing member cooperates with an extended end of the elongated lock member to retain the lock in a clamped position between the opposing walls of the guide rail so that the closed gate is captured therebetween. The securing member is under the operative control of a rotatable portion of the lock.

19 Claims, 15 Drawing Figures

LOCKING SYSTEM FOR ROLLING TYPE GATE

BACKGROUND OF THE INVENTION

This invention relates to locking systems, and more particularly to a locking system for a rolling type gate of the kind typically utilized in front of store windows and the like.

In order to provide security for store windows, parking lots, and other enclosed areas, there is typically utilized a rolling type gate which is stored in a fixed upper header and is lowered to provide closure of the protected area. The rolling type gate generally includes a plurality of slats which are hingedly interconnected to each other to permit their rolling up into the header. The rolling type gate has its ends movable within U-shaped channels serving as side guide rails, or tracks, for the rolling type gate.

When the gate is lowered into its closed position, a suitable locking mechanism is required to prevent unauthorized opening of the gate. Typically, tabs can be formed both on the side rails and on an adjacent slat of the rolling type gate, where a hasp of a padlock is inserted through aligned apertures formed in the mating tabs. While the use of such padlocks is somewhat effective, the locks can be jimmied, or cut, using various burglary tools to break open the padlock and permit unauthorized opening of the rolling type gate.

U.S. Pat. No. 4,345,448 describes a more secure type of locking system for such rolling type gates. In this system, an ear extends from the exterior of a guide rail and is received within a bracket having a pin insertable through an aperture formed into each of the opposing walls of the guide rail and through an aligned aperture in the slat positioned between the opposing walls of the guide rail. A specially designed closure lock is then applied onto the ear, and a bolt slidable within the lock assembly is depressed to retain the lock on the ear. A second retaining system is included by terminating the bracket in a barrier wall having a curved edge wall which fits into the curvature of the individual slats of the rolling type gate.

The essential concern of a suitable locking system is one that will prevent unauthorized access by means of burglarizing tools. Accordingly, the lock must be provided with appropriate guard plates to avoid insertion of a chisel, tool, or the like, between various parts of the locking system, whereby the entire lock could be chiseled off the guide rail. Additionally the head portion of the lock should be appropriately protected to avoid the possibility of grasping the head of the lock and completely ripping the lock from the guide rail.

SUMMARY OF THE INVENTION

Accordingly, it is an object of the present invention to provide an improved locking system for a rolling type gate.

Another object of the present invention is to provide a gate locking system which can provide secure locking of a rolling type gate within its guide rails.

Still a further object of the present invention is to provide a gate locking system which provides for suitable lock guards to avoid unauthorized entry by means of burglarizing tools.

Yet another object of the present invention is to provide a gate locking system utilizing a plug type lock which is adequately protected to avoid unauthorized penetration of the locking system.

Briefly, in accordance with the present invention, there is provided a gate locking system for securely locking a rolling type gate in its closed position within an opposing pair of U-shaped channel guide rails. A locking section is provided on at least one of the guide rails and includes aligned apertures formed through the opposing walls of the guide rail section. The gate is movable within the walls of the guide rails between an open and closed position. An aperture is formed through one of the slats of the gate and is aligned with the apertures in the locking section of the guide rails when the gate is in its closed position. A guard plate is positioned exteriorly of the locking section of the guide rails. An opening is formed in the guard plate which is aligned with the above mentioned apertures. An elongated tubular type lock is provided which has an enlarged lock head in which a key can be inserted. The elongated tubular lock is insertable through a passageway defined by the opening in the guard plate and the gate and guide rail apertures, and the lock extends beyond the guide rail. The enlarged lock head is retained forward of the guide rails by means of the guard plate. Suitable securing devices cooperate with the extended end of the tubular lock for securing the lock between the opposing walls of the guide rails when the gate is in its closed position. The securing devices operate under control of the key insertable in the lock.

In an embodiment of the present invention, a lock guard is positioned with respect to the enlarged lock head for preventing unauthorized tampering with the lock. In one form, the lock guard is a tray attached to the exterior of the guide rails for snugly receiving the guard plate. In another form of the present invention, the lock guard is a collar ring in which the enlarged lock head sits. Still another form of the present invention provides a lock guard in the form of a face plate with a raised welt in which the enlarged lock head is seated. The face plate can be secured onto the guard plate or can be secured directly onto the exterior of the guide rail and spaced therefrom to define a receiving slot in which the guard plate is inserted.

These and other objects, features and advantages of the present invention will, in part, be pointed out with particularity and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawing, like reference characters designate like parts.

DESCRIPTION OF THE PREFERRED EMBODIMENTS

Figure 1:
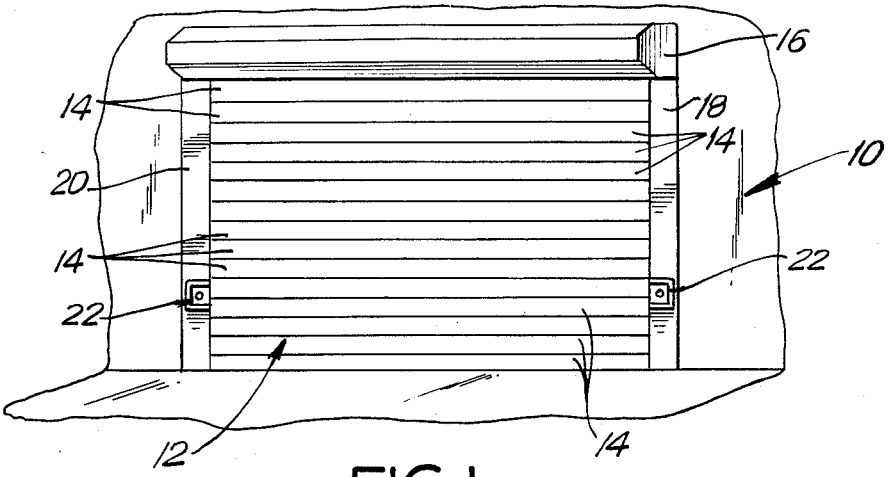
FIG. 1 is a perspective view of a typical rolling type gate positioned in front of an area to be protected, and is shown in its closed position secured by the locking system of the present invention.

FIG. 1 shows a typical rolling type gate system 10 on which the present invention finds use. The rolling type gate 12 is usually formed of a plurality of individual elongated slats or panels 14 connected to each other in a hingable manner so as to be able to roll up into the header 16 for storage when not in use, as is well known in the art. In order to close the rolling type gate, the gate is pulled down to form a substantially solid wall covering the storefront or the like. The gate is movable in a pair of substantially U-shaped channels positioned on either side of the gate, which receive the ends of the gate so as to form tracks or guide rails 18, 20 in which the gate is movable between its open and closed position, as is also well known in the art. The gate is locked in its closed position by means of the locking system 22 of the present invention, the locking system 22 being preferably located on both sides of the gate, though it is understood that only one locking system 22 may be used on only one selected side of the gate.

Figure 2:
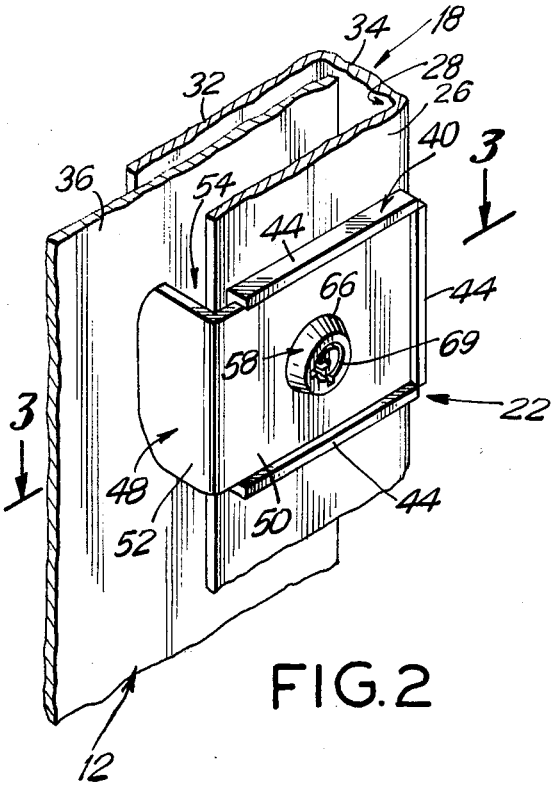
FIG. 2 is a fragmentary, partially sectioned, enlarged perspective view of a locking section of one of the guide rails, including a portion of the rolling type gate positioned therebetween.
Figure 3:
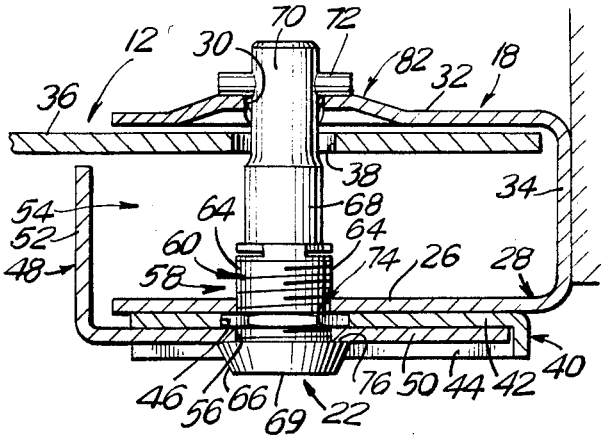
FIG. 3 is a cross sectional view taken along line 3—3 of FIG. 2.
Figure 4:
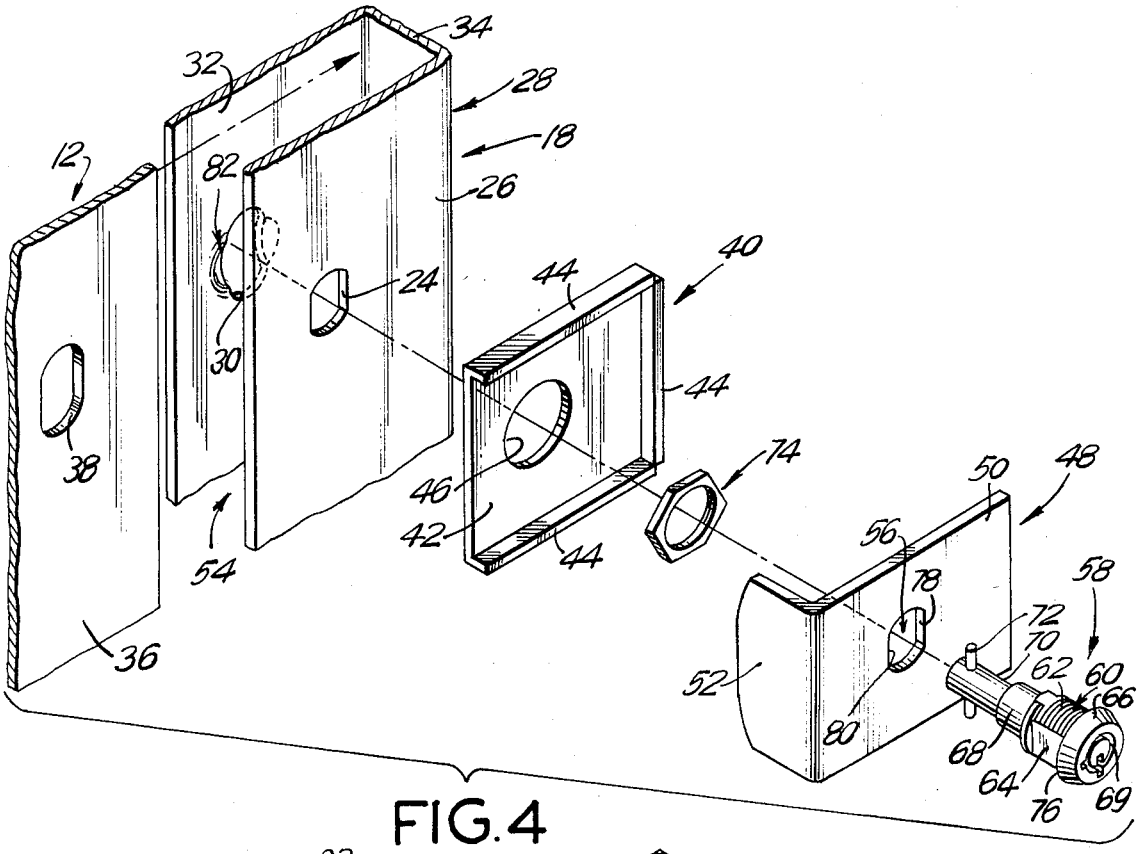
FIG. 4 is an exploded perspective view of the locking section shown in FIG. 2.

With reference now to FIGS. 2–4, only the locking system 22 on the right side of FIG. 1 is shown, where the one on the left side is the same, being turned upside down by 180° to accommodate the left side of the gate 12, so that a showing thereof is not thought necessary. Therefore, each locking system 22 includes a series of aligned apertures defining a passageway in which a tubular lock can be inserted. More specifically, an oval shaped aperture 24 is formed in the front wall of a section of the U-shaped channel 28 forming the side guide rail 18. An aligned oval aperture 30 is similarly formed in the opposing rear wall 32 of the side guide rail 18. The interconnecting side or bight wall 34 of the side guide rail 18 spaces apart the two opposing front and rear walls 26, 32.

Received between the two walls 26, 32, of the side guide rail 18 is a slat or panel 36 of the rolling type gate 12, the slat 36 being a specific one of the slats 14. Accordingly, an oval shaped aperture 38 is formed in the slat 36, which will be aligned with the apertures 24 and 30 of the side guide rail 18 when the gate 12 is in its closed position.

Positioned exteriorly of the wall 26 is a guard tray 40 including a base wall 42 which is securely mounted onto the exterior of the wall 26 by means of welding, or the like. A peripheral upstanding rim 44 surrounds the base 42 on three sides thereof with the fourth side, corresponding to the opening of the channel 28, being opened. A substantially circular aperture 46 is formed in the base 42 which is aligned with the apertures 24 and 30 of the side guide rail 18.

An L-shaped guard plate 48 includes a front wall 50 with a side wall 52 substantially perpendicular to the front wall 50. The front wall 50 is shaped to snugly fit within the peripheral rim 44 of the guard tray 40. The thickness of the front wall 50 is less than the height of the peripheral rim 44 so that the guard plate 48 can seat within the guard tray 40.

With the guard plate 48 seated in the guard tray 40, the side wall 52 will be directed toward the slat 36 of the rolling type gate 12 and thereby substantially close off the mouth 54 of the channel 28. This will prevent a burglary tool, such as a chisel or the like, from being inserted into the mouth 54 to cut the lock. An oval shaped aperture 56 is provided in the front wall 50 which is aligned with the other apertures 24 and 30 of the side guide rail 18.

A conventional tubular shaped lock 58 is provided which includes a conventional cylinder portion 60 having a peripheral thread 62 formed about a portion thereof with flats 64 on the two opposite sides thereof. An enlarged lock head 66 is provided in which a conventional key can be inserted into a lock face 69. The peripheral wall of the lock head 66 is frustroconical in shape and terminates in a shoulder 76. A shaft 68 and a reduced smaller diameter shaft 70 at the end thereof, extends axially from the cylinder portion 60, and is rotatable with respect to the lock cylinder portion 60 under control of the rotation of the key inserted within the lock face 69 in a conventional manner well known in the lock art, where the description of the lock 58 and tumblers therein is not thought necessary.

A transverse pin 72 is positioned at the distal end of the shaft 70. The length of the distal pin 72 is greater than the minor diameter of the oval aperture 30 in the rear wall 32 of the channel. However, the length of the pin 72 is less than the major diameter of the oval aperture 30. In this manner, there is a clearance fit of the pin 72 into the major diameter of oval aperature 30, and an interference fit with respect to the minor diameter of the oval aperture 30.

A lock nut 74 is provided which can threadably engage the thread 62 of the lock cylinder portion 60 and secure the lock 58 to the guard plate 48, when such a secure arrangement is desired.

In operational use, the gate 12 is lowered whereby the slat 36 is positioned between the front and rear walls 26, 32 of the U-shaped channel 28, and the slat aperture 38 is aligned between the guide rail apertures 24 and 30. The lock 58 is inserted into the aperture 56 of the guard plate 48 with the underside shoulder 76 of the enlarged lock head 66 forming a stop that abuts the face plate 50 of the guard plate 48. As a result, the guard plate serves as a stop for retaining the lock 58 from passing therethrough.

The shape of the oval aperture 56 of the guard plate 48 is such that the sides 78, 80 thereof are flat and engage the flats 64 of the lock cylinder portion 60, whereby the lock cylinder portion 60 cannot rotate with respect to the guard plate 48.

The lock 58 can be secured in place by means of tightening the lock nut 74 on the cylinder portion 60 to form a lock unit. Alternately, it should be appreciated, that no lock nut 74 is needed at all, and the lock 58 can still be utilized by simply inserting it into the guard plate 48 without locking it in place.

The shaft portions 68, 70 of the lock 58 are then inserted into the passageway defined by the apertures 46, 24, 38 and 30. The transverse pin 72 will pass through the major diameter of the aperture 30 in the rear wall 32 of the guide rail 18. The apertures 24 and 38 can be either oval, whereupon its major diameter should be greater than the length of the pin 72, or they can be circular with the diameter being greater than the transverse pin 72. In this way, the pin 72 can pass through these apertures 24, 38.

With the lock 58 inserted in the passageway, the guard plate 48 will be seated in the guard tray 40. The aperture 46 is made large enough to accommodate the lock nut 74 to thereby prevent spacing of the guard plate 48 away from the base 42 of the guard tray 40. It is noted that the aperture 24 in the front wall 26 has the same dimensions as the guard plate aperture 56 to receive the lock cylinder portion 60 therethrough, as best shown in FIG. 3, and to also prevent rotation of the lock cylinder portion 60.

The gate 12 can now be locked in place by rotating the key, not shown, whereby the shafts 68 and 70 rotate with respect to the lock cylinder portion 60, thereby carrying with it the transverse pin 72. The pin 72 is rotated in back of the rear wall 32 until it is placed across the minor diameter of the aperture 30, where it provides an interference with the back surface of the rear wall 32, thereby preventing removal of the lock 58.

In order to tightly secure the lock 58 in the guide rail 18 when in the locked position, the rear wall 32 of the channel 28 can be outwardly stamped to provide a bulge 82 in the wall adjacent the minor diameter of the aperture 30. This bulge 82 serves as a cam surface for tightly retaining the transverse pin 72 secured on the high surface of the bulge 82 when it is in the locked position across the minor diameter of the aperture 30, as best shown in FIG. 3.

With the lock 58 now in its locked position, the guard plate 48 is securely retained in the guard tray 40 and the side wall 52 functions as a barrier to close the mouth 54 of the channel 28. It should be noted, that the side wall 52 does not have to engage the slat 36 of the gate 12, but can be slightly spaced therefrom, as shown in FIG. 3. Nevertheless, the side wall 52 is sufficient to prevent insertion of a burglarizing tool into the mouth 54 to break the shafts 68, 70 of the lock 58.

Utilizing the gate locking system 10, as shown, a burglarizing tool will not be able to be inserted between the various parts of the plates. For example, the burglarizing tool will not be able to be inserted between the guard plate 48 and the guard tray 40 because of the peripheral rim 44. At the same time, a standard tubular lock can be utilized without the need for any special lock design. The shape of the slat 36 of the gate 12 can now be flat and not arcuate, as was required in prior art locking systems.

Figure 5:
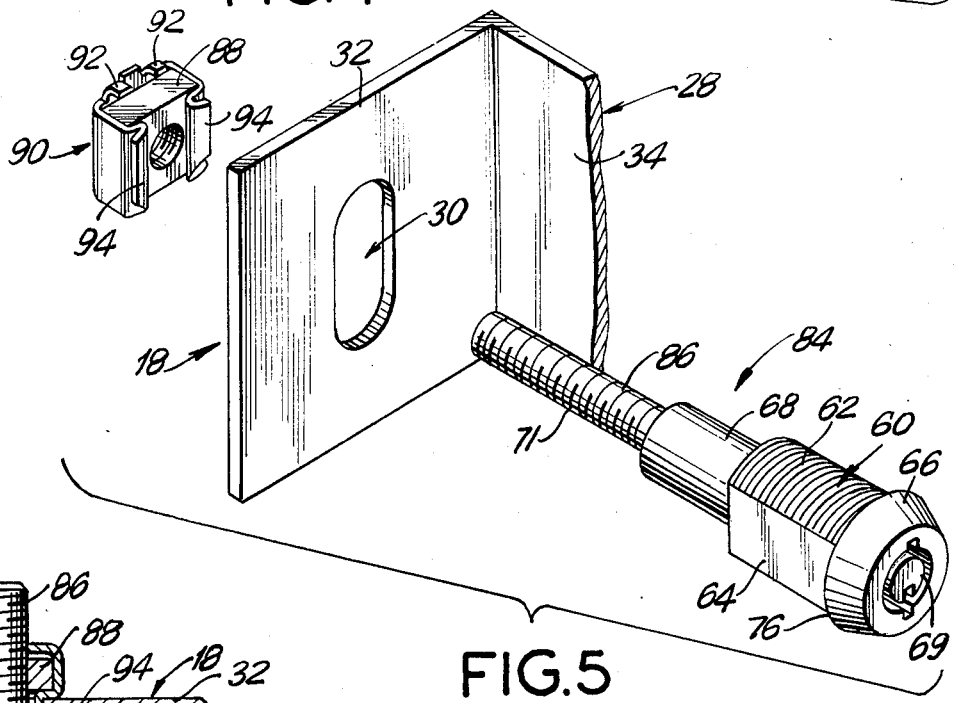
FIG. 5 is an exploded perspective view showing another embodiment of a lock for use with the gate locking system of the present invention.
Figure 6:
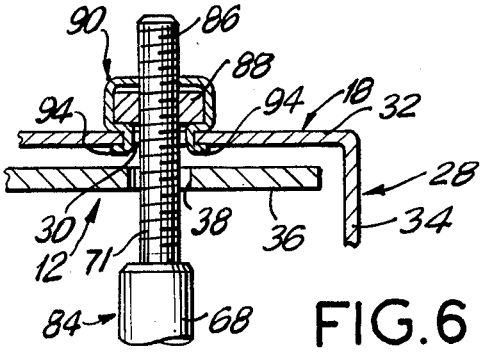
FIG. 6 is a fragmentary cross sectional view showing the lock of FIG. 5 in its locked position.

Referring to FIGS. 5 and 6, there is shown another type of conventional lock 84 having similar parts to the above mentioned lock 58 except for the shaft 70, which can be utilized with the present gate locking system 22. As shown, the shaft 71 (similar to the shaft 70) is threaded at 86. Accordingly, the lock 84 is of a type that the tumblers in the cylinder portion 60, and therefore the shafts 71 and 68, can be continuously rotated by means of the key inserted into the lock face 69, such type of lock being well known in the lock art.

A nut 88 is retained by means of a U-shaped bracket 90 and held in place within the bracket 90 by means of the tabs 92 on the upper and lower parts of the bracket 90. Arms 94 extending outwardly on either side of the bracket 90, engage the side walls of the aperture 30 in the rear wall 32 of the U-shaped channel 28.

With the lock 84 inserted through the various passageways in the same manner as mentioned above, the threads 86 on the shaft 71 will engage in the nut 88. Continuous rotation of the key in the lock 84 will serve to thread the shaft 71 into the nut 88 to thereby tighten the lock 84 within the walls of the U-shaped channel 28, so that the shaft 71 is retained in the gate aperture 38, as shown in FIG. 6, to prevent the opening of the gate 12.

With either type of lock 58, 84 as described, once in its locked position, the lock extends through the aperture 38 in the gate 12 and securely clamps across the walls of the U-shaped channel 28 to retain the gate 12 in a secured position between the walls of the channel 28. The locking system 22 thereby provides a secure way of closing the gate 12 while preventing unauthorized burglary of the locking system 22.

Figure 7:
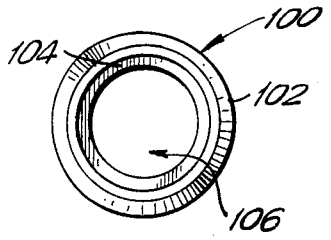
FIG. 7 is a front view of a collar guard ring for use in protecting the tubular locks being utilized in the present invention.
Figure 8:
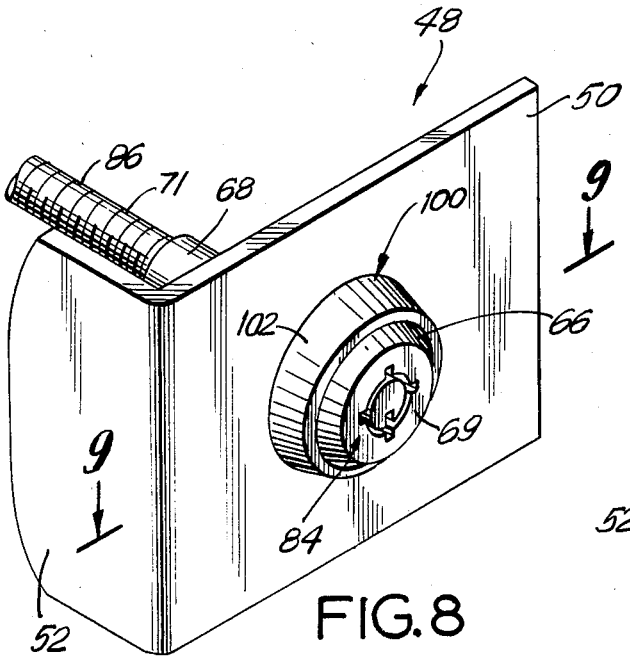
FIG. 8 is a perspective view of the guard plate supporting one of the tubular locks with the collar guard ring serving to protect the lock.
Figure 9:
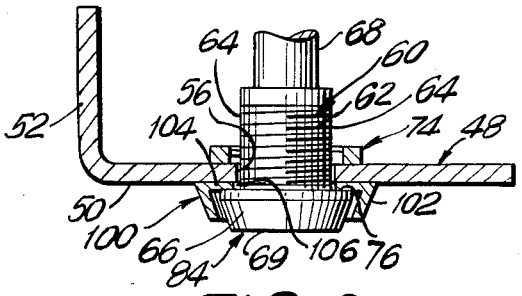
FIG. 9 is a cross sectional view taken along line 9—9 of FIG. 8.

In order to provide additional protection, the head 66 of either lock 58, 84 can be further protected by means of a lock guard of various types. For example, referring to FIGS. 7–9, a lock guard collar 100 is utilized for surrounding the enlarged head 66 of the lock 84 as shown in FIGS. 8 and 9, or of the lock 58 as understood. The collar 100 includes a peripheral wall 102 which is frustroconical in shape and terminates at its lower end in an inwardly directed flange 104 defining a seat for receiving the underside of the shoulder 76 of the enlarged lock head 66. A circular aperture 106 is defined within the inwardly directed flange 104 for receiving the lock cylinder portion 60. The collar 100 is positioned forward of the guard plate 48 and receives the lock therethrough. The size of the peripheral walls 102 of the collar is such that it snugly receives the lock head 66.

With the collar 100 in place, it prevents an unauthorized burglarizing tool from grabbing the lock head 66 and pulling it out of position. It also prevents access between the lock head 66 and the guard plate 48 for insertion therein of a burglarizing tool such as a chisel. It is noted, that the collar 100 is free to rotate relative to the lock head 66, so that twisting or rotating the collar 100 with a tool will not effect the lock head 66.

Figure 10:
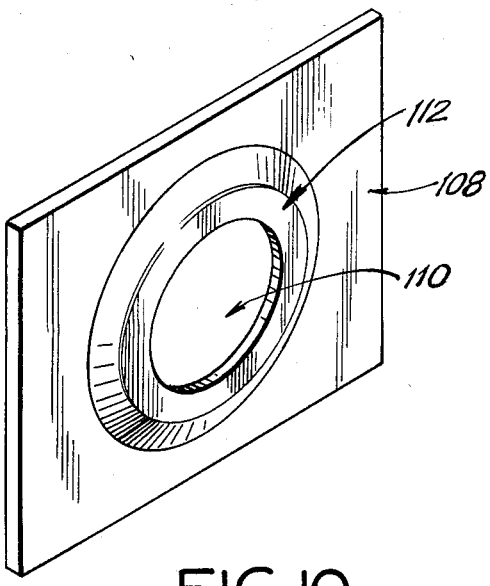
FIG. 10 is a perspective view of a face plate serving as an additional lock guard for the tubular locks of the present invention.
Figure 11:
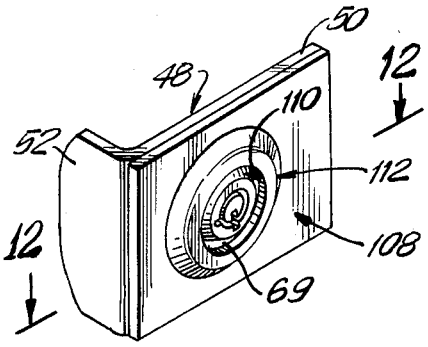
FIG. 11 is a view showing the face plate secured onto the guard plate, and showing the positioning of the head of the lock member with respect to the face plate.
Figure 12:
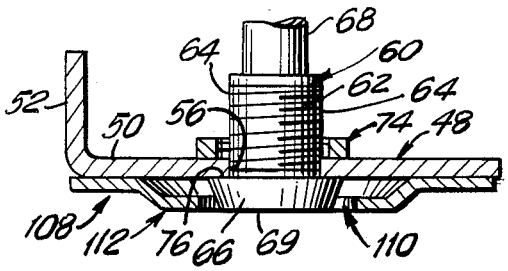
FIG. 12 is a cross sectional view taken along line 12—12 of FIG. 11.

An additional type of lock guard is shown in FIGS. 10–12. In this embodiment, the lock guard is a face plate 108 which can be directly mounted onto the front wall 50 of the guard plate 48 by means of welding or the like. The face plate 108 includes a substantially circular aperture 110 therethrough coaxial with the aperture 56 provided in the guard plate 48, and the other apertures in the walls of the U-shaped channel 28, as well as the aperture 38 in the gate 12.

Surrounding the aperture 110, there is provided a circular welt 112 which forms a raised ridge on the plate 108 to space it forward of the guard plate 48. The enlarged head 66 can thereby be recessed within the space provided by the welt 112. Again, it will be impossible for grasping of the lock head 66 by means of pliers or a burglarizing tool to rip the head 66 of the lock 58 or 84 and break into the gate locking system 22.

Figure 13:
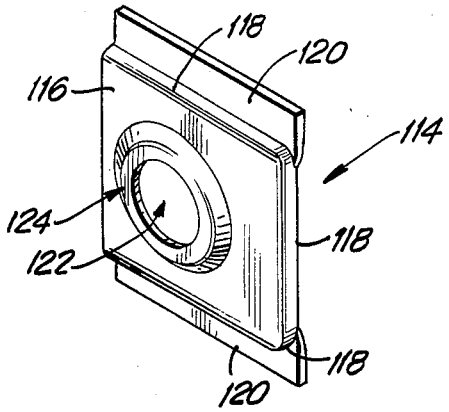
FIG. 13 is a perspective view of another type of face plate assembly for use in protecting the tubular locks being utilized in the present invention.
Figure 14:
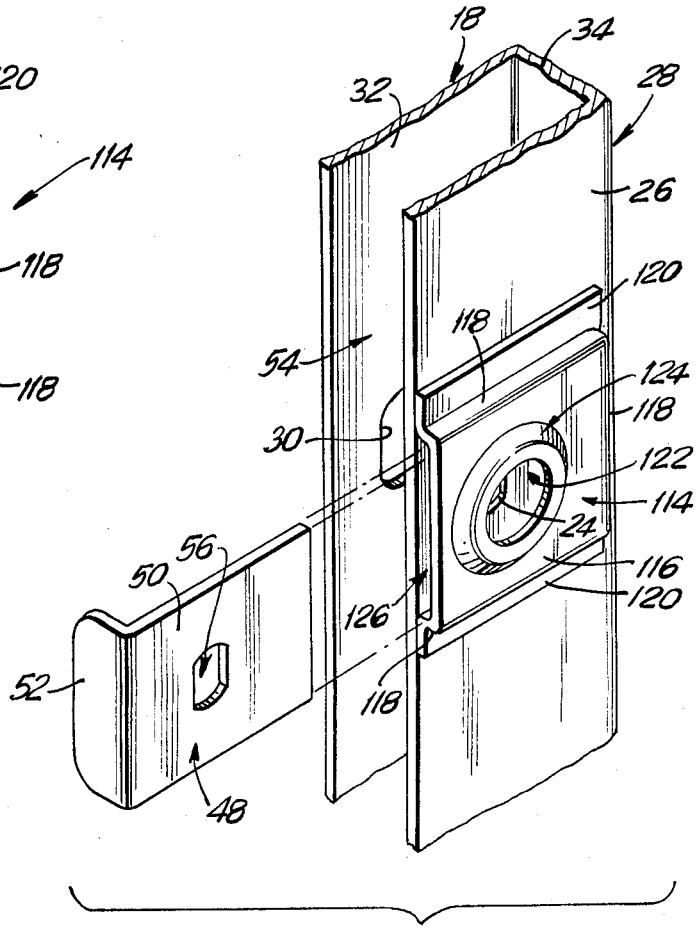
FIG. 14 is a fragmentary perspective view showing the mounting of the face plate assembly of FIG. 13 onto the exterior of one of the guide rails and showing the positioning of the guard plate with respect to the face plate assembly.
Figure 15:
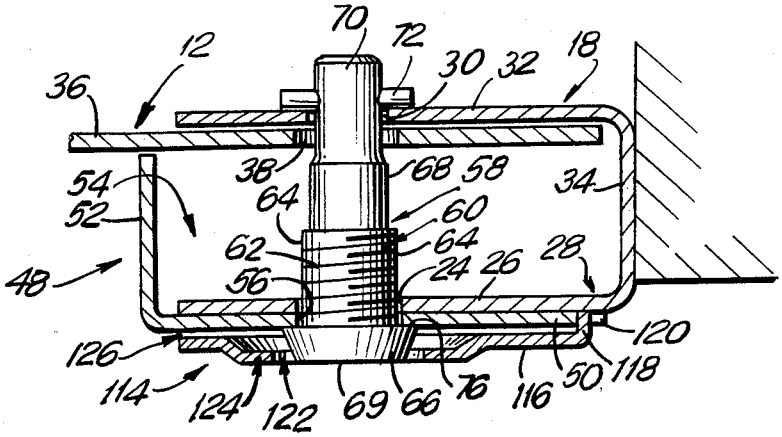
FIG. 15 is a cross sectional view showing insertion of one of the tubular locks in the assembled locking system of FIG. 14.

FIGS. 13, 14 and 15 show yet a further lock guard 114. The lock guard 114 includes a face plate 116 with a rearwardly directed peripheral lip 118 about three sides thereof. The side of the face plate 116 corresponding with the opening 54 in the channel 28 is left open without a lip. At the upper and lower edges, the lip 118 continues into a flange 120 to permit the securing of the face plate 116 directly onto the exterior front wall 26 of the U-shaped channel 28. A circular aperture 122 is provided in the plate 118 which is aligned with front wall aperture 24 and the other apertures previously described. Here again, a welt 124 surrounds the aperture 122 to provide a raised portion about the aperture 122 to space it forward of the guard plate 48, as set forth below.

The side without the lip 118 defines a mouth 126 of a compartment in which the guard plate 48 can be slid, as indicated in FIG. 14. The lock 58 as shown, or the lock 84 as understood, is then inserted into the various above mentioned apertures, as shown in FIG. 15. The enlarged lock head 66 will be recessed in the space provided by the welt 124. In this manner, the lock 58 or 84 is secured to prevent a burglarizing tool from grasping the lock head 66 and twisting it or pulling it out of the channel 28. At the same time, the guard plate 48 is protected by means of the front face plate 116 and the peripheral lip 118. Unauthorized insertion of a burglarizing tool is thereby prevented, so that the lock shaft 71 as shown in FIG. 15, or the lock shaft 70 as understood, is retained in the gate aperture 38 to prevent the opening of the gate 12.

Using the heretofore described gate locking system, there is utilized a simplified system with standard tubular type locks. At the same time, the various parts of the locking system are protected to prevent unauthorized penetration of the locking system and prevent various types of burglarizing tools from being inserted to destroy the lock arrangement. Furthermore, there are a reduced number of parts which can be lost. When desired, the lock can be secured onto the guard plate whereby only one part is needed for securing the entire locking system and providing a protected locking arrangement.

There has been disclosed heretofore the best embodiments of the invention presently contemplated. However, it is to be understood that various changes and modifications may be made thereto without departing from the spirit of the present invention.

What is claimed is:

1. A gate locking system comprising:

a gate;

at least one U-shaped channel guide rail;

a locking section on said guide rail including aligned apertures extending through opposing front and rear walls of said guide rail;

said gate being moveable within said guide rail between an open and a closed position, and said gate including an aperture aligned with said guide rail apertures when in said closed position;

a guard plate having an opening therein for positioning exteriorly of said locking section with said opening being aligned with said guide rail and gate apertures in said closed position;

an elongated lock member having an enlarged lock head, said lock member being insertable through a passageway defined by said opening, said guide rail apertures, and said gate aperture, said inserted lock member extending beyond said rear wall of said guide rail with said enlarged lock head being retained by said guard plate;

a lock guard positioned around said enlarged lock head for preventing tampering thereof, said lock guard including a tray member having a base wall and at least three upstanding side rims, and an aperture provided in said base wall;

said tray member being secured exteriorly onto said guide rail front wall at said locking section with said tray member aperture being aligned with said guide rail apertures to receive said lock member, said guard plate being received on said tray member within said tray member side rims to thereby prevent entry of a burglarizing tool between said guard plate and said guide rail; and securing means cooperating with an extended end of said lock member for securing said lock member between said opposing front and rear walls of said guide rail with said gate being captured in said closed position to securely lock said gate in said closed position, said securing means being under operative control of a rotatable portion of said lock member.

2. A gate locking system as in claim 1, wherein said guard plate includes a front wall section for overlying said guide rail front wall, and a side barrier wall section substantially perpendicular to said front wall section for extending towards said guide rail rear wall to thereby prevent entry of a burglarizing tool into a mouth of said channel guide rail at said locking section.

3. A gate locking system as in claim 1, further comprising a collar ring having a peripheral wall terminating at its lower end in an inwardly directed flange serving as a seat for receiving and surrounding said enlarged lock head to thereby prevent grasping of said enlarged lock head with a burglarizing tool, said collar ring being positioned on said guard plate.

4. A gate locking system as in claim 3, wherein said peripheral wall of said collar ring is inwardly angled in a direction toward its upper end.

5. A gate locking system as in claim 1, further comprising a face plate having an aperture with a raised welt surrounding said face plate aperture, said face plate being secured onto said guard plate with its aperture aligned with said guard plate opening, said enlarged lock head being received within said face plate aperture and being recessed in a space provided by said raised welt to thereby prevent grasping of said enlarged lock head with a burglarizing tool.

6. A gate locking system as in claim 1, wherein said lock member includes an exteriorly threaded barrel portion adjacent to said enlarged lock head and further comprising a locking nut threaded on said barrel portion rearward of said guard plate to secure said locking member to said guard plate.

7. A gate locking system as in claim 1, wherein said lock member includes a barrel housing axially extending from said enlarged lock head and supporting a lock cylinder, and an axially extending shaft rotatable with respect to said barrel housing to define said rotatable portion of said lock member.

8. A gate locking system as in claim 7, wherein said barrel housing includes flat sides, and wherein said opening in said guard plate is oval in shape to receive said barrel housing, said barrel housing being prevented from rotating with respect to said guard plate.

9. A gate locking system as in claim 1, wherein at least said guide rail rear wall aperture is oval in shape, and wherein said securing means includes a transverse pin at said extended end of said lock member, said pin providing a clearance fit with respect to a major diameter of said oval aperture and an interference fit with respect to a minor diameter of said oval aperture, whereby said lock member is freely insertable into said passageway, and by rotation of said transverse pin, said pin is locked behind said oval aperture against a rear surface of said guide rail rear wall.

10. A gate locking system as in claim 9, wherein said guide rail rear wall includes a cam surface at said oval aperture for tightening said transverse pin into its locking position.

11. A gate locking system as in claim 1, wherein said extended end of said lock member is threaded, said securing means including a fixed nut secured to said guide rail rear wall coaxial with said rear wall aperture therein, said extended end being threaded into said nut under operation of said rotatable portion of said lock member.

12. A gate locking system comprising:

a gate;

at least one U-shaped channel guide rail;

a locking section on said guide rail including aligned apertures extending through opposing front and rear walls of said guide rail;

said gate being moveable within said guide rail between an open and a closed position, and said gate including an aperture aligned with said guide rail apertures when in said closed position;

a guard plate having an opening therein for positioning exteriorly of said locking section with said opening being aligned with said guide rail and gate apertures in said closed position;

an elongated lock member having an enlarged lock head, said lock member being insertable through a passageway defined by said opening, said guide rail apertures, and said gate aperture, said inserted lock member extending beyond said rear wall of said guide rail with said enlarged lock head being retained by said guard plate;

a lock guard positioned around said enlarged lock head for preventing tampering thereof, said lock guard including a housing mounted onto an exterior of said guide rail front wall at said locking section;

a slot provided at one end of said housing adjacent a mouth of said channel guide rail for slidably receiving therein said guard plate, and an aperture provided in said housing aligned with said guide rail apertures to receive said lock member, said housing preventing entry of a burglarizing tool between said guard plate and said guide rail; and securing means cooperating with an extended end of said lock member for securing said lock member between said opposing front and rear walls of said guide rail with said gate being captured in said closed position to securely lock said gate in said closed position, said securing means being under operative control of a rotatable portion of said lock member.

13. A gate locking system as in claim 12, wherein said guard plate includes a front wall section for overlying said guide rail front wall, and a side barrier wall section substantially perpendicular to said front wall section for extending towards said guide rail rear wall to thereby prevent entry of a burglarizing tool into a mouth of said channel guide rail at said locking section.

14. A gate locking system as in claim 12, wherein said lock member includes a barrel housing axially extending from said enlarged lock head and supporting a lock cylinder, and an axially extending shaft rotatable with respect to said barrel housing to define said rotatable portion of said lock member.

15. A gate locking system as in claim 14, wherein said barrel housing includes flat sides, and wherein said opening in said guard plate is oval in shape to receive said barrel housing, said barrel housing being prevented from rotating with respect to said guard plate.

16. A gate locking system as in claim 12, wherein at least said guide rail rear wall aperture is oval in shape, and wherein said securing means includes a transverse pin at said extended end of said lock member, said pin providing a clearance fit with respect to a major diameter of said oval aperture and an interference fit with respect to a minor diameter of said oval aperture, whereby said lock member is freely insertable into said passageway, and by rotation of said transverse pin, said pin is locked behind said oval aperture against a rear surface of said guide rail rear wall.

17. A gate locking system as in claim 16, wherein said guide rail rear wall includes a cam surface at said oval aperture for tightening said transverse pin into its locking position.

18. A gate locking system as in claim 12, wherein said extended end of said lock member is threaded, said securing means including a fixed nut secured to said guide rail rear wall coaxial with said rear wall aperture therein, said extended end being threaded into said nut under operation of said rotatable portion of said lock member.

19. A gate locking system as in claim 12, wherein a front wall of said housing includes a raised welt surrounding said housing aperture, said enlarged lock head being received within said housing aperture and being recessed in a space provided by said raised welt to thereby prevent gripping of said enlarged lock head with a burglarizing tool.

* * * * *